US012313272B2

(12) United States Patent
Bauer, Jr. et al.

(10) Patent No.: US 12,313,272 B2
(45) Date of Patent: May 27, 2025

(54) HVAC SYSTEM AND METHODS OF USING THE SAME FOR LEAK DETECTION

(71) Applicant: Advanced Distributor Products LLC, Richardson, TX (US)

(72) Inventors: John Lawson Bauer, Jr., Grenada, MS (US); Austin Mitchell Meminger, Oxford, MS (US); Timothy James Orr, Bogart, GA (US)

(73) Assignee: Advanced Distributor Products LLC, Richardson, TX (US)

( * ) Notice: Subject to any disclaimer, the term of this patent is extended or adjusted under 35 U.S.C. 154(b) by 246 days.

(21) Appl. No.: 18/068,901

(22) Filed: Dec. 20, 2022

(65) Prior Publication Data

US 2024/0200813 A1 Jun. 20, 2024

(51) Int. Cl.
*F24F 11/36* (2018.01)
*F24F 7/06* (2006.01)

(52) U.S. Cl.
CPC ..... *F24F 11/36* (2018.01); *F24F 7/06* (2013.01)

(58) Field of Classification Search
CPC ..... F24F 7/06; F24F 11/36; F25B 2500/23; F25B 2500/24; F25B 2600/112; F25B 2700/04
See application file for complete search history.

(56) References Cited

U.S. PATENT DOCUMENTS

| | | | | |
|---|---|---|---|---|
| 12,000,631 | B1 * | 6/2024 | Gill | F25B 49/005 |
| 2021/0404685 | A1 * | 12/2021 | Butler | F24F 11/84 |
| 2023/0349576 | A1 * | 11/2023 | Zhang | F24F 11/64 |
| 2024/0263819 | A1 * | 8/2024 | Becerra | F24F 11/36 |

* cited by examiner

*Primary Examiner* — Marc E Norman
(74) *Attorney, Agent, or Firm* — Baker Botts L.L.P.

(57) ABSTRACT

A method of operating a HVAC system is provided. The method includes removing heat from a working fluid using an evaporator and a blower that moves airflow across the evaporator. The method includes measuring at least one gas property value of a fluid surrounding the evaporator using a leak detection sensor. The method includes determining a control setpoint for a maximum allowable concentration of working fluid in the fluid surrounding the evaporator, where the control setpoint corresponds to a gas property value associated with a threshold percentage of a lower flammability limit of the first refrigerant in air at the operating temperature. The method includes determining that the at least one gas property value of the working fluid exceeds the control setpoint. If exceeded, the method includes closing a value that regulates the flow of working fluid to the evaporator and initiating the blower to move airflow across the evaporator.

17 Claims, 5 Drawing Sheets

HVAC SYSTEM AND METHODS OF USING THE SAME FOR LEAK DETECTION

TECHNICAL FIELD

This disclosure relates generally to heating, ventilation, and air conditioning (HVAC) systems. More particularly, in certain embodiments, this disclosure relates to an HVAC system and methods of using the same for leak detection.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

Regulations in the HVAC industry are pushing manufacturers to transition away from traditional refrigerants towards low global warming potential (GWP) refrigerants, particularly mildly flammable (A2L) refrigerants. To accommodate for the changes, manufacturers may need to design HVAC systems, including evaporator coils, to be optimized specific to the A2L refrigerants (e.g., R-32 and/or R-454B). Particularly, each evaporator coil may need a leak detection sensor to sense the mildly flammable A2L refrigerant. One of the challenges that will arise from these changes is that many wholesale distributors sell products from multiple manufacturers and sell to contractors that service equipment from multiple manufactures. With different A2L refrigerants in the market simultaneously, this will likely force distributors to stock different HVAC systems for each A2L refrigerant. This disclosure addresses the aforementioned problems by providing an HVAC system with a leak detection sensor that can be used for multiple A2L refrigerants and mixtures of different A2L refrigerants, thereby eliminating the need for distributors to stock multiple HVAC models that are tailored and/or optimized to a specific A2L refrigerant, reducing stock keeping units (SKUs) and complexity.

In an embodiment, the present disclosure provides a HVAC system that is configured to regulate a temperature of a space. The HVAC system comprises an evaporator positioned in a duct system and coupled to a working fluid conduit. The working fluid conduit comprises a working fluid that includes at least a first refrigerant. The HVAC system further comprises an expansion valve in the working fluid conduit configured to regulate a flow of the working fluid to the evaporator, and a blower positioned in the duct system, where the blower is configured to move airflow across the evaporator and out of the duct system. The HVAC system further comprises a leak detection sensor positioned in or adjacent to the duct system and configured to measure at least one gas property value and an operating temperature of the fluid in the duct system. The leak detection sensor is further configured to measure at least one gas property value and an operating temperature of the fluid in the duct system. The leak detection sensor is further configured to determine a control setpoint for a maximum allowable concentration of working fluid in the duct system, wherein the control setpoint is determined to be a gas property value associated with a threshold percentage of a lower flammability limit of the first refrigerant in air at the operating temperature. The leak detection sensor is further configured to determine that the at least one gas property value exceeds the control setpoint at the operating temperature. The HVAC system further includes a controller comprising a processor and a memory, the controller communicatively coupled to the leak detection sensor. In some embodiments, after determining that the at least one gas property value exceeds the control setpoint, the controller is configured to initiate the blower to move airflow across the evaporator for a duration.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 5 of the drawings, like numerals being used for like and corresponding parts of the various drawings.

As described above, regulations in the HVAC industry are pushing manufacturers to transition away from traditional refrigerants towards low global warming potential (GWP) refrigerants, particularly mildly flammable (A2L) refrigerants. To accommodate for the changes, manufacturers may need to design HVAC systems, including evaporator coils, to be optimized for a specific A2L refrigerant (e.g., R-32 or R-454B). Particularly, each evaporator coil may need a leak detection sensor to sense the mildly flammable A2L refrigerant. One of the challenges that will arise from these changes is that many wholesale distributors sell products from multiple manufacturers and sell to contractors that service equipment from multiple manufactures. With different A2L refrigerants in the market simultaneously, this will likely force distributors to stock different HVAC systems for each A2L refrigerant. This disclosure addresses the aforementioned problems by providing an HVAC system with a leak detection sensor that can be used for multiple A2L refrigerants and mixtures of different A2L refrigerants, thereby eliminating the need for distributors to stock multiple HVAC models that are tailored and/or optimized to a specific A2L refrigerant, reducing stock keeping units (SKUs) and complexity.

HVAC System

Figure 1:
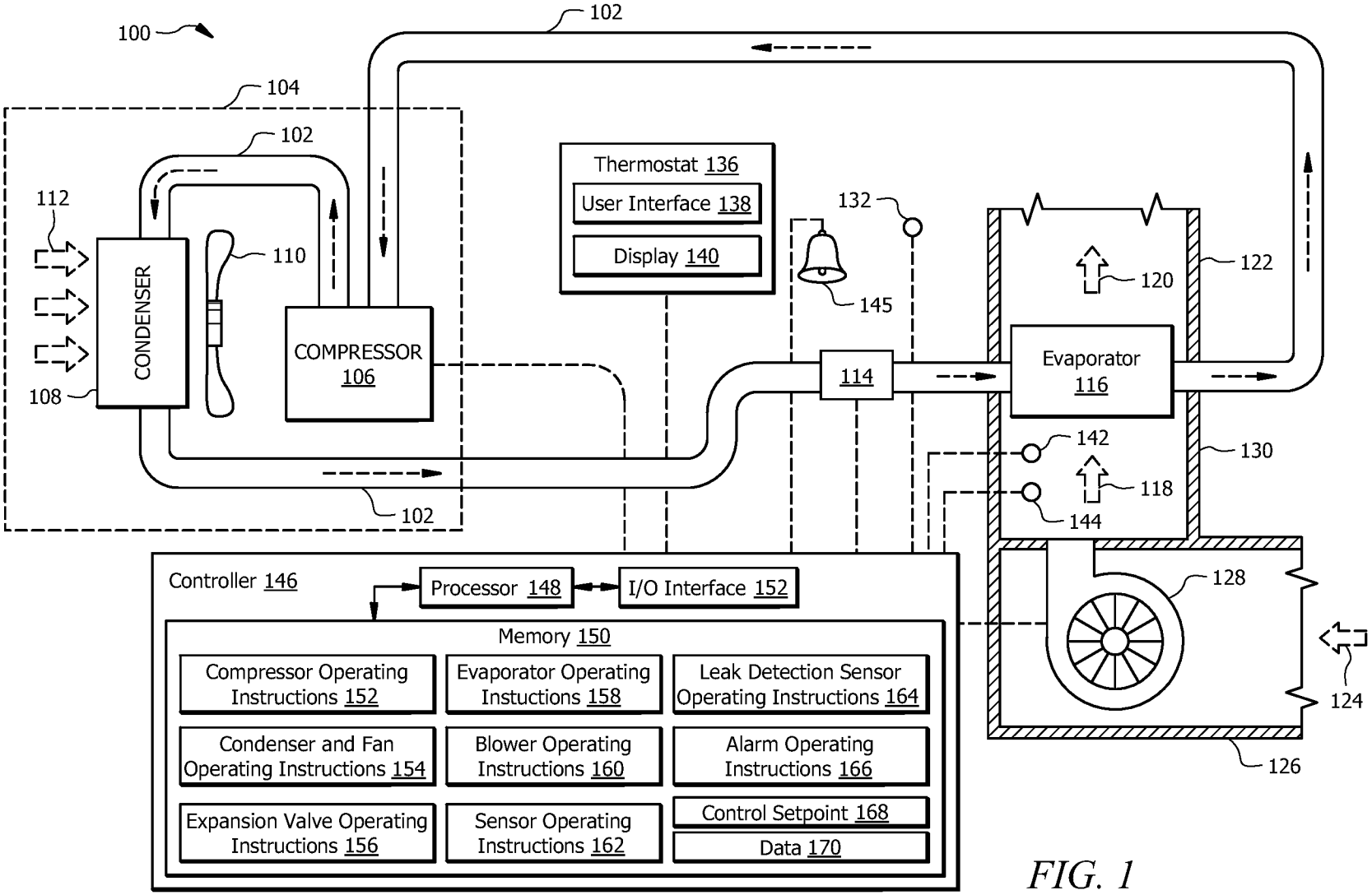
FIG. 1 is a diagram of an HVAC system having a leak detection sensor according to some embodiments of the present disclosure.

FIG. 1 shows an example HVAC system 100 according to an embodiment of the present disclosure. The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building, and the conditioned air is delivered into the interior of the building. In other embodiments, portion(s) of the system 100 may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working fluid conduit 102, at least one condensing unit 104, an expansion valve 114, an evaporator 116, a blower 128, one or more thermostats 136, and a controller 146. The working fluid conduit 102 facilitates the movement of a working fluid (e.g., one or more refrigerant) through a cooling cycle such that the working fluid flows as illustrated by the dashed arrows in FIG. 1. In some embodiments, the working fluid comprises multiple refrigerants, for example, at least a first refrigerant and a second refrigerant. In some embodiments, the working fluid comprises a mildly flammable A2L refrigerant. As used herein, the term "mildly flammable A2L refrigerant" may be defined in one embodiment according to ASHRAE Standard 34. In one example, according to the ASHRAE Standard 34, the mildly flammable A2L refrigerant meets all four of the following conditions: (i) exhibits flame propagation when tested at 140° F.) (60° ° C. and 14.7 psia (101.3 kPa); (ii) has a lower flammability limit (LFL)>0.0062 lb/ft$^3$ (0.10 kg/m$^3$); (iii) has a heat of combustion<8169 Btu/lb (19,000 KJ/kg); and (iv) has a maximum burning velocity of ≤3.9 in/s (10 cm/s) when tested at 73.4° F. (23° C.) and 14.7 psia (101.3 kPa) in dry air. Suitable examples of mildly flammable A2L refrigerants include, but are not limited to, R-32, R-454b, or combinations thereof.

The condensing unit 104 comprises a compressor 106, a condenser 108, and a fan 110. In some embodiments, the condensing unit 104 is an outdoor unit while other components of the HVAC system 100 may be located indoors. In some embodiments, the compressor 106 is a variable speed compressor that can be operated at a range of speeds. The compressor 106 is coupled to the working fluid conduit 102 and compresses (i.e., increases the pressure) of the working fluid. The compressor 106 is in signal communication with the controller 146 using wired and/or wireless connection. The controller 146 provides commands and/or signals to control operation of the compressor 106 and/or receive signals form the compressor 106 corresponding to a status of the compressor 106.

The condenser 108 is configured to facilitate movement of the working fluid through the working fluid conduit 102. The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing therethrough. The fan 110 may be in communication with the controller 146 (e.g., via wired and/or wireless communication) to receive control signals for turning the fan 110 on and off and/or adjusting a speed of the fan 110. The compressed, cooled working fluid flows from the condenser 108 toward the expansion valve 114.

The expansion valve 114 is coupled to the working fluid conduit 102 downstream of the condenser 108 and is configured to remove pressure from the working fluid. In this way, the working fluid is delivered to the evaporator 116. In general, the expansion valve 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 114 may be in communication with the controller 146 (e.g., via wired and/or wireless communication) to receive control signals for opening and/or closing associated valves and/or to provide flow measurement signals corresponding to the rate of working fluid flow through the working fluid conduit 102.

The evaporator 116 is generally any heat exchanger configured to provide heat transfer between air flowing through (or across) the evaporator 116 (i.e., airflow 118 contacting an outer surface of one or more coils of the evaporator 116) and working fluid passing through the interior of the evaporator 116. The evaporator 116 may include one or more circuits of coils. The evaporator 116 is fluidically connected to the compressor 106, such that working fluid generally flows from the evaporator 116 to the condensing unit 104 when the HVAC system 100 is operating to provide cooling.

A portion of the HVAC system 100 is configured to move airflow 118 provided by the blower 128 across the evaporator 116 and out of a duct system 122 as conditioned airflow 120. Return air 124, which may be air returning from the building, fresh air from outside, or some combination, is pulled into a return duct 126. A suction side of the blower 128 pulls the return air 124. The blower 128 discharges airflow 118 into a duct 130 such that airflow 118 crosses the evaporator 116 or heating elements (not shown) to produce conditioned airflow 120. The blower 128 is any mechanism for providing airflow 118 through the HVAC system 100. For example, the blower 128 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower.

The HVAC system 100 includes a room sensor 132 in signal communication with the controller 146 (e.g., via wired and/or wireless connection). Room sensor 132 is positioned and configured to measure an indoor air temperature. The HVAC system 100 may include one or more further sensors (not shown for conciseness), such as sensors for measuring air humidity and/or any other properties of a conditioned space (e.g., a room of the conditioned space). Room sensor 132 and/or any other sensors may be positioned anywhere within the conditioned space, the HVAC system 100, and/or the surrounding environment.

The thermostat 136 may be located within the conditioned space (e.g., a room or building) serviced by the HVAC system 100. In some embodiments, the controller 146 may be separate from or integrated within the thermostat 136. The thermostat 136 is configured to allow a user to input a desired temperature or baseline setpoint temperature for the conditioned space. In some embodiments, the thermostat 136 includes a user interface 138 and display 140 for displaying information related to the operation and/or status of the HVAC system 100. For example, the user interface 138 may communicate with the display 140 to show operational, diagnostic, and/or status messages and provide a visual interface that allows at least one of an installer, a user, a support entity, and a service provider to perform actions with respect to the HVAC system 100. For example, the user interface 138 may communicate with the display 140 to show messages related to the status and/or operation of the HVAC system 100.

The HVAC system 100 includes at least one leak detection sensor 142 in signal communication with the controller 146 (e.g., via wired and/or wireless connection). The leak detection sensor 142 is positioned in or adjacent to the duct system 122. The leak detection sensor 142 is configured to measure at least one gas property value of fluid in the duct system 122, which may include working fluid that has leaked from the evaporator 116. In some embodiments, the fluid in the duct system 122 is fuel (e.g., natural gas or propane). The at least one gas property value of the fluid in the duct system 122 may be used to determine a concentration of working fluid that has leaked from the evaporator 116 into in the fluid surrounding the evaporator 116 and/or within the duct system 122. Suitable gas property values include, but are not limited to, the speed of sound in the fluid, thermal conductivity of the fluid, or combinations thereof. The multiple leak detection sensors 144 may additionally or alternatively be configured at different spatial locations within the duct system to improve detection and/or response to a leak of working fluid.

Figure 2:
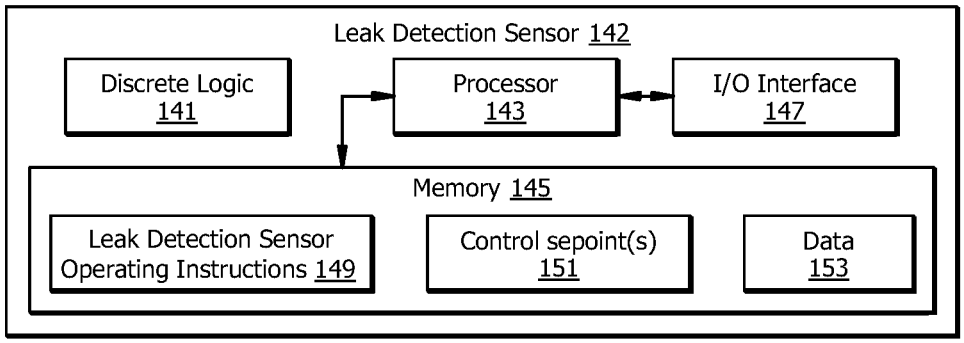
FIG. 2 is a diagram of a leak detection sensor according to some embodiments of the present disclosure.

Referring to FIG. 2, in some embodiments, the leak detection sensor 142 may include discrete logic 141. In some embodiments, the discrete logic 141 may operate to acquire and process information measured by the leak detection sensor 142. The discrete logic 141 may also perform any of the functions described herein. Additionally or alternatively, the leak detection sensor 142 may include a processor 143, a memory 145, and an input/output (I/O) interface 157. The processor 143 comprises one or more processors operably coupled to the memory 145. The processor 143 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 145 and controls the leak detection sensor 142. The processor 143 may be a programmable logic device, a microcontroller, a microprocessor, or any suitable combination of the preceding. The processor 143 is communicatively coupled to and in signal communication with the memory 145. The one or more processors are configured to process data and may be implemented in hardware or software. For example, the processor 143 may be 8-bit, 16-bit, 32-bit, 64-bit or of any other suitable architecture. The processor 143 may include an arithmetic logic unit (ALU) for performing arithmetic and logic operations, processor registers that supply operands to the ALU and store the results of ALU operations, and a control unit that fetches instructions from memory 145 and executes them by directing the coordinated operations of the ALU, registers, and other components. The processor 143 may include other hardware and software that operates to process acquired information and perform any of the functions described herein. The processor 143 is not limited to a single processing device and may encompass multiple processing devices.

The memory 145 includes one or more disks, tape drives, or solid-state drives, and may be used as an over-flow data storage device, to store programs when such programs are selected for execution, and to store instructions and data that are read during program execution. The memory 145 may be volatile or non-volatile and may comprise ROM, RAM, ternary content-addressable memory (TCAM), dynamic random-access memory (DRAM), and static random-access memory (SRAM). The memory 145 is operable to store any suitable set of instructions, logic, rules, and/or code for executing the functions described in this disclosure. For example, the memory 145 may store leak detection sensor operating instructions 149 for acquiring one or more fluid property value, control setpoints 151, and data 153.

The I/O interface 147 is configured to communicate data and signals with other devices. For example, the I/O interface 147 may be configured to communicate electrical signals with the other components of the HVAC systems 100. The I/O interface 147 may comprise ports and/or terminals for establishing signal communications between the leak detection sensor 142 and other devices. The I/O interface 147 may be configured to enable wired and/or wireless communications. Connections between various components of the HVAC system 100 and between components of system 100 may be wired or wireless. For example, conventional cable and contacts may be used to couple the controller 146 or various other components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 146 to other components of the HVAC system 100.

In some embodiments, the HVAC system 100 includes at least one sensor 144 positioned in or adjacent to the duct system 122. The at least one sensor 144 may be configured to measure a temperature and/or pressure of the fluid in the duct system 122. The at least one sensor 144 may be used to measure the temperature of the fluid in the duct system 122 in addition to the leak detection sensor 142 or as an alternative to the leak detection sensor 142. In some embodiments, the at least one sensor 144 includes a temperature sensor, a pressure sensor, or a combination thereof. In other embodiments, the sensor 144 is a dual temperature pressure sensor. The leak detection sensor 142 and the at least one sensor 144 may be positioned anywhere within the duct system 122 and/or the surrounding environment.

The HVAC system 100 includes an alarm 145 in signal communication with the leak detection sensor 142 and/or the controller 146 (e.g., wired and/or wireless connection). In some embodiments, the alarm 145 is located within the conditioned space (e.g., a room or building) serviced by the HVAC system 100. Although not illustrated in FIG. 1, the alarm 245 may be integrated into the thermostat 136. As will be described in more detail below, the alarm 145 is configured to trigger if at least one gas property value measured by the leak detection sensor 142 exceeds a control setpoint 168 at a given temperature and/or pressure of the working that has leaked from the evaporator 116.

The controller 146 is communicatively coupled (e.g., via wired and/or wireless connection) to components in the HVAC system 100 and configured to control their operation. In some embodiments, controller 146 can be one or more controllers associated with one or more components of the HVAC system 100. The controller 146 includes a processor 148, memory 150, and an input/output (I/O) interface 152. The processor 148 comprises one or more processors operably coupled to the memory 150. The processor 148 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 150 and controls the operation of HVAC system 100. The processor 148 may be a programmable logic device, a microcontroller, a microprocessor, or any suitable combination of the preceding. The processor 148 is communicatively coupled to and in signal communication with the memory 150. The one or more processors are configured to process data and may be implemented in hardware or software. For example, the processor 148 may be 8-bit, 16-bit, 32-bit, 64-bit or of any other suitable architecture. The processor 148 may include an arithmetic logic unit (ALU) for performing arithmetic and logic operations, processor registers that supply operands to the ALU and store the results of ALU operations, and a control unit that fetches instructions from memory 150 and executes them by directing the coordinated operations of the ALU, registers, and other components. The processor 148 may include other hardware and software that operates to process information, control the HVAC system 100, and perform any of the functions described herein. The processor 148 is not limited to a single processing device and may encompass multiple processing devices.

The memory 150 includes one or more disks, tape drives, or solid-state drives, and may be used as an over-flow data storage device, to store programs when such programs are selected for execution, and to store instructions and data that are read during program execution. The memory 150 may be volatile or non-volatile and may comprise ROM, RAM, ternary content-addressable memory (TCAM), dynamic random-access memory (DRAM), and static random-access memory (SRAM). The memory 150 is operable to store any suitable set of instructions, logic, rules, and/or code for executing the functions described in this disclosure. For example, the memory 150 may store compressor operating instructions 152, condenser and fan operating instructions 154, expansion valve operating instructions 156, evaporator operating instructions 158, blower operating instructions 160, sensor operating instructions 162, leak detection sensor operating instructions 164, alarm operating instructions 166, control setpoint(s) 168, and data 170 (e.g., gas property values measured from the leak detection sensor 142, temperature and pressure values measured from the at least one sensor 144 or room sensor 132, and/or operating parameters for components in the system 100).

The I/O interface 152 is configured to communicate data and signals with other devices. For example, the I/O interface 152 may be configured to communicate electrical signals with the other components of the HVAC systems 100. The I/O interface 152 may comprise ports and/or terminals for establishing signal communications between the controller 146 and other devices. The I/O interface 151 may be configured to enable wired and/or wireless communications. Connections between various components of the HVAC system 100 and between components of system 100 may be wired or wireless. For example, conventional cable and contacts may be used to couple the thermostat 136 to the controller 146 and various components of the HVAC system 100, including, the compressor 106, the expansion valve 114, the blower 128, the leak detection sensor 142, the at least one sensor 144, and the room sensor 132. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 146 to other components of the HVAC system 100.

In some embodiments, the leak detection sensor 142 is configured to continuously or intermittently monitor working fluid that has leaked from the evaporator 116 to the duct system 122. The following actions may be performed by the leak detection sensor 142 alone (e.g., by using discrete logic 141 and/or the processor 149 within the leak detection sensor 142). Additionally or alternatively, the controller 146 may be configured to perform these functions using the leak detection sensor 142, the processor 148, the memory 150, the I/O interface 152. In some embodiments, the leak detection sensor 142 is configured to measure at least one gas property value of the fluid in the duct system 122. For example, the leak detection sensor 142 may measure a speed of sound of the fluid, a thermal conductivity of the fluid, or a combination thereof. The measured gas property values may be stored as data 170 in the memory 150 in the controller 144. The measured gas property values may fluctuate with temperature and pressure, as well as other operating parameters like humidity. Accordingly, the leak detection sensor 142 may be further configured to measure the temperature and/or pressure of the fluid in the duct system 122. Alternatively, the leak detection sensor 142 may be used to measure the gas property value and the sensor 144 may be configured to measure the temperature and/or pressure of the fluid in the duct system 122. In some embodiments, the pressure of the fluid in the duct system 122 is assumed to be atmospheric pressure for the given location. In this case, it may not be necessary to continuously or intermittently measure the pressure of the fluid in the duct system 122.

In some embodiments, the leak detection sensor 142 and/or the controller 146 are configured to determine a control setpoint 168. The control setpoint 168 may correspond to a maximum allowable concentration of working fluid in the duct system 122. The leak detection sensor 142 and/or the controller 146 may determine the control setpoint 168 in a number of ways. For example, in the case where the working fluid comprises a first refrigerant, the leak detection sensor 142 and/or the controller 146 may determine the control setpoint 168 to be a gas property value (e.g., speed of sound or thermal conductivity) associated with a threshold percentage of a lower flammability limit (LFL) of the first refrigerant in air at the operating temperature and pressure. The threshold percentage may be at least 5% of the lower flammability limit, at least 6%, at least 7%, at least 8%, at least 9%, at least 10%, at least 11%, at least 12%, at least 13%, at least 14%, at least 15%, at least 20%, at least 25%, to less than 30%, less than 40%, or less than 50% of the lower flammability limit of the first refrigerant in air at the operating temperature and pressure.

In some embodiments, the leak detection sensor 142 and/or the controller 146 are configured to determine that the at least one gas property value exceeds the control setpoint 168 at the operating temperature and pressure. After determining that the at least one gas property value exceeds the control setpoint 168, the controller 146 is configured initiate the blower 128 to move airflow 118 across the evaporator 116 for a duration to remove leaked working fluid from the duct system 122. The duration may be a set duration (e.g., at least 10 seconds to 24 hours or more) or the blower 128 may operate until the leak detection sensor 142 measures at least one gas property value that is below the control setpoint 168. In some embodiments, the controller 146 is configured to trigger the alarm 145 if the at least one gas property value of the fluid exceeds the control setpoint 168 at the operating temperature and pressure.

Figure 3:
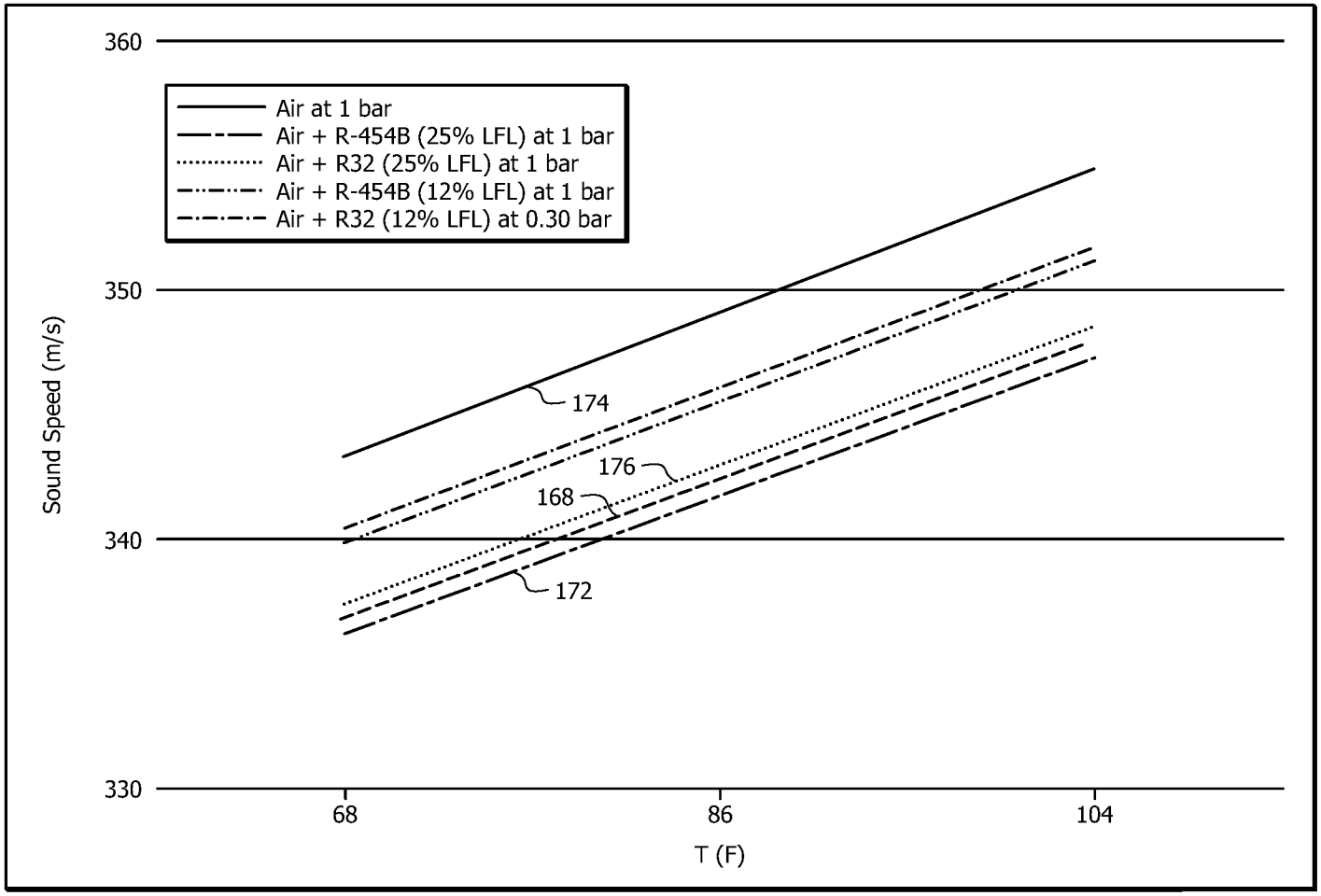
FIG. 3 is a plot illustrating an example control setpoint that is determined as a gas property value (e.g., speed of sound) that falls between a gas property value associated with a threshold percentage of a lower flammability limit of a first refrigerant in air and a gas property value associated with air at the operating temperature and pressure.

In the case where the working fluid comprises a first refrigerant and a second refrigerant, the leak detection sensor 142 and/or the controller 146 may determine the control setpoint 168 in a number of ways. To aid in describing how the leak detection sensor 142 and/or the controller 146 determines the control setpoint 168 for a mixture of refrigerants, reference is made to FIG. 3 which shows an exemplary plot for the speed of sound in air, a first fluid comprising air and a first refrigerant (R-454B at 25% LFL), a second fluid comprising air and a second refrigerant (R-32 at 25% LFL), a third fluid comprising air and the first refrigerant (R-454B at 12% LFL), and a fourth fluid comprising air and the second refrigerant (R-32 at 12% LFL). As shown in FIG. 3, the speed of sound decreases as the concentration of R-32 and R-454B increase. The speed of sound is higher for a particular concentration of R-32 than at the same concentration of R-454b. In other words, the gas property value (e.g., speed of sound) for the first refrigerant (R-454b) is lower than the gas property value of the second refrigerant (R-32) at the same threshold percentage of the lower flammability limit for the respective refrigerant in air at the same operating temperature and pressure. In some embodiments, the leak detection sensor 142 and/or the controller 146 are configured to determine the control setpoint 168 to be a gas property value that falls between the gas property value 172 associated with the threshold percentage of the lower flammability limit of the first refrigerant in air at the operating temperature and pressure, and a gas property value 174 associated with air at the operating temperature and pressure. In some embodiments, the leak detection sensor 142 and/or the controller 146 may be configured to determine which refrigerant between the first refrigerant and the second refrigerant has the lower gas property value at the operating temperature and pressure by referencing data 170 in the memory 150.

In some embodiments, the leak detection sensor 142 and/or the controller 146 are configured to determine the setpoint 168 as a gas property value that falls between the gas property value 172 associated with the threshold percentage of the lower flammability limit of the first refrigerant at the operating temperature and pressure, and the gas property value 176 associated with the threshold percentage of the lower flammability limit of the second refrigerant at the operating temperature and pressure. In some embodiments, the leak detection sensor 142 and/or the controller 146 are configured to determine the control setpoint 168 to be an average between the gas property value 172 associated with the threshold percentage of the lower flammability limit of the first refrigerant at the operating temperature and pressure, and the gas property value 176 associated with a threshold percentage of the lower flammability limit of the second refrigerant at the operating temperature and pressure. In some embodiments, the average is scaled based on a concentration of the first refrigerant and the second refrigerant in the working fluid.

Figure 4:
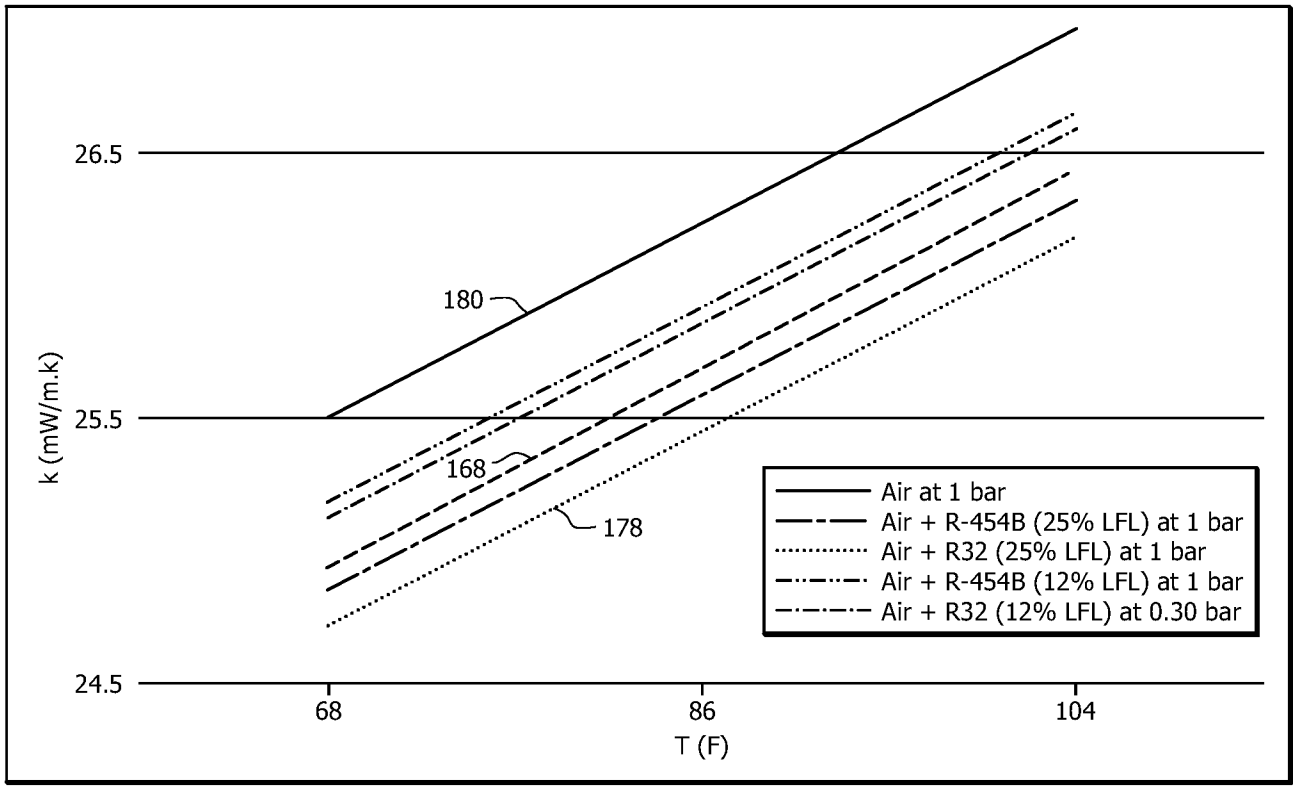
FIG. 4 is a plot illustrating an example control setpoint that is determined as a gas property value (e.g., thermal conductivity) that falls between a gas property value associated with a threshold percentage of a lower flammability limit of a first refrigerant in air and a gas property value associated with air at the operating temperature and pressure.

Referring to FIG. 4, an exemplary plot is shown for the thermal conductivity of air, a first fluid comprising air and a first refrigerant (R-454B at 25% LFL), a second fluid comprising air and a second refrigerant (R-32 at 25% LFL), a third fluid comprising air and the first refrigerant (R-454B at 12% LFL), and a fourth fluid comprising air and the second refrigerant (R-32 at 12% LFL). As shown in FIG. 4, the thermal conductivity decreases as the concentration of R-32 and R-454B increase. The thermal conductivity is higher for a particular concentration of R-454b than at the same concentration of R-32 (converse of speed of sound). In this case, the leak detection sensor 142 and/or the controller 146 may determine that the gas property value for R-32 is lower than R-454b at the operating temperature and pressure, for example, by referencing data 170 in the memory 150. Once it is determined that the gas property value for R-32 is lower than R-454b, the leak detection sensor 142 and/or the controller 146 are configured to determine the control setpoint 168 to be a gas property value that falls between the gas property value 178 associated with the threshold percentage of the lower flammability limit of R-32 in air at the operating temperature and pressure, and a gas property value 180 associated with air at the operating temperature and pressure.

In some embodiments, a measurement uncertainty factor may be used to adjust the control setpoint 168. For example, after determining the control setpoint 168, the leak detection sensor 142 and/or the controller 146 may adjust the control setpoint 168 further with a measurement uncertainty factor. The measurement uncertainty factor may be added such that the control setpoint 168 triggers at a lower value compared to the original control setpoint 168, e.g., by at least one multiple of the expected measurement uncertainty to avoid failing to trigger if the measured concentration is less than the actual concentration. For example, if the measurement uncertainty is +2%, the controller 146 may adjust the control setpoint 168 with the measurement uncertainty factor to trigger at least 2% lower than the original control setpoint 168 determined by the controller 14 to ensure proper operation. The measurement uncertainty factor would may include measurement tolerance of the sensor, as well as other factors like response time, impact of air flow, etc.

Figure 5:
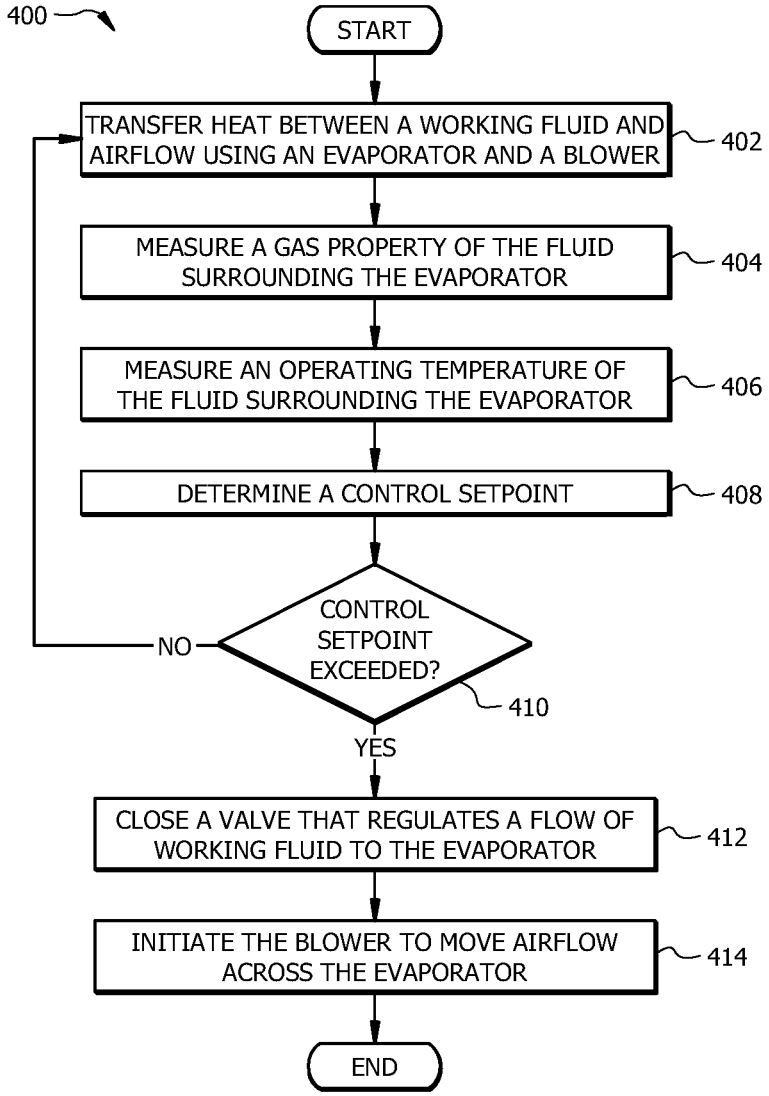
FIG. 5 is a flowchart of an example method of operating the system of FIG. 1.

FIG. 5 is a flowchart of an example method 400 of operating the system 100 of FIG. 1. Operations of the method 400 may be implemented using the leak detection sensor 142 and/or the controller 146, processor 148, memory 150, and the I/O interface 152, as describe above. Method 400 may begin at operation 402, which includes transferring heat between a working fluid in a working fluid conduit 102 and airflow 118 using an evaporator 116 that is coupled to the working fluid conduit 102 and a blower 128 that moves the airflow 118 across the evaporator 116. At operation 404, the method 400 includes measuring at least one gas property value of a fluid surrounding the evaporator 116 using the leak detection sensor 142. At operation 406, the method 400 includes measuring an operating temperature and/or pressure of the fluid surrounding the evaporator 116 using the leak detection sensor 142 and/or at least one sensor 144.

At operation 408, the method 400 includes determining a control setpoint 168 for a maximum allowable concentration of working fluid in the fluid surrounding the evaporator. The control setpoint 168 corresponds to a gas property value associated with a threshold percentage of a lower flammability limit of a first refrigerant in air at the operating temperature. At operation 410, the method 400 includes determining if the at least one gas property value of the working fluid measured by the leak detection device 142 exceeds the control setpoint at the operating temperature. If the control setpoint 168 is not exceeded, then the method returns to operation 402. If the control setpoint is exceeded, the method 400 proceeds to operation 412. At operation 412, the method 400 includes closing the expansion valve 114 that regulates the flow of the working fluid to the evaporator 116. At operation 414, the method includes initiating the blower to move airflow across the evaporator for a duration.

In some embodiments, the working fluid includes a first refrigerant and a second refrigerant. When the working fluid includes a mixture of refrigerants, the control setpoint 168 may be determined in a number of ways. For example, operation 408 may include determining if the first refrigerant or the second refrigerant has a lower gas property value at the threshold percentage of the lower flammability limit at the operating temperature. If the first gas property value of the first refrigerant is lower than the gas property value of the second refrigerant at the percentage of the lower flammability limit, operation 408 may further include determining the control setpoint 168 to be a gas property value that falls between the gas property value associated with the threshold percentage of the lower flammability limit of the first refrigerant in air at the operating temperature and a gas property value associated with air at the operating temperature.

In some embodiments, operation 408 includes determining the control setpoint 168 to be a gas property value that falls between the gas property value associated with the threshold percentage of the lower flammability limit of the first refrigerant at the given operating temperature and pressure and a gas property value associated with the threshold percentage of a lower flammability limit of the second refrigerant at the given operating temperature. In some embodiments, operation 408 includes determining the control setpoint 168 to be an average between the gas property value associated with the threshold percentage of the lower flammability limit of the first refrigerant at the given operating temperature and pressure and the gas property value associated with a threshold percentage of the lower flammability limit of the second refrigerant at the given operating temperature.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system configured to regulate a temperature of a space, the HVAC system comprising:

an evaporator positioned in a duct system and coupled to a working fluid conduit, wherein the working fluid conduit comprises a working fluid that comprises at least a first refrigerant;

an expansion valve in the working fluid conduit configured to regulate a flow of the working fluid to the evaporator;

a blower positioned in the duct system, the blower configured to move airflow across the evaporator and out of the duct system;

a leak detection sensor configured to:

measure at least one gas property value and an operating temperature of the fluid in the duct system;

determine a control setpoint for a maximum allowable concentration of working fluid in the duct system, wherein the control setpoint is determined to be a gas property value associated with a threshold percentage of a lower flammability limit of the first refrigerant in air at the operating temperature;

determine that the at least one gas property value exceeds the control setpoint at the operating temperature;

a controller comprising a processor and a memory, the controller communicatively coupled to the leak detection sensor and the blower, wherein after determining that the at least one gas property value exceeds the control setpoint the controller configured to:

initiate the blower to move airflow across the evaporator for a duration;

wherein the working fluid comprises a first refrigerant and a second refrigerant;

wherein the gas property value of the first refrigerant is lower than the gas property value of the second refrigerant at the threshold percentage of the lower flammability limit for the respective refrigerant in air at the operating temperature; and wherein the leak detection sensor is further configured to determine the control setpoint to be a gas property value that falls between the gas property value associated with the threshold percentage of the lower flammability limit of the first refrigerant in air at the operating temperature and a gas property value associated with air at the operating temperature.

2. The HVAC system of claim 1, wherein the control setpoint is determined as a gas property value that falls between the gas property value associated with the threshold percentage of the lower flammability limit of the first refrigerant at the given operating temperature and a pressure and a gas property value associated with the threshold percentage of a lower flammability limit of the second refrigerant at the given operating temperature.

3. The HVAC system of claim 2, wherein the control setpoint is determined to be an average between the gas property value associated with the threshold percentage of the lower flammability limit of the first refrigerant at the given operating temperature and the pressure and the gas property value associated with a threshold percentage of the lower flammability limit of the second refrigerant at the given operating temperature.

4. The HVAC system of claim 3, wherein the average gas property value between the first refrigerant and the second refrigerant is scaled based on a concentration of the first refrigerant and the second refrigerant in the working fluid.

5. The HVAC system of claim 2, wherein the first refrigerant and the second refrigerant are A2L refrigerants.

6. The HVAC system of claim 1, wherein the at least one gas property value is selected from a speed of sound, thermal conductivity, or combination thereof.

7. The HVAC system of claim 1, wherein the leak detection sensor is a first leak detection sensor, further comprising a second leak detection sensor positioned in or adjacent to the duct system, wherein the second leak detection sensor is configured to measure at least one gas property value of the fluid that is different than the at least one gas property value measured by the first leak detection sensor.

8. The HVAC system of claim 1, further comprising an alarm communicatively coupled to the leak detection sensor, wherein the leak detection sensor includes instructions for triggering the alarm, and the leak detection sensor is configured to:

trigger the alarm if the at least one gas property value of the fluid exceeds the control setpoint at the operating temperature.

9. A controller of a heating, ventilation, and air conditioning (HVAC) system, the controller comprising:

an interface communicatively coupled to a leak detection sensor and a blower, wherein the leak detection sensor is configured to measure at least one gas property value of a fluid surrounding an evaporator in a duct system and an operating temperature of the fluid in the duct system;

a memory having instructions for measuring the at least one gas property value and the operating temperature using the leak detection sensor; and a processor communicatively coupled to the interface and the memory, the processor configured to:

measure at least one gas property value and the operating temperature of the fluid using the leak detection sensor;

determine a control setpoint for a maximum allowable concentration of working fluid in the duct system, wherein the control setpoint is determined to be a gas property value associated with a threshold percentage of a lower flammability limit of the first refrigerant in air at the operating temperature;

determine that the at least one gas property value measured by the leak detection sensor exceeds the control setpoint at the operating temperature, and after determining that the at least one gas property value exceeds the control setpoint:

initiate the blower to move airflow across the evaporator for a duration;

wherein the working fluid comprises a first refrigerant and a second refrigerant;

wherein the gas property value of the first refrigerant is lower than the gas property value of the second refrigerant at the threshold percentage of the lower flammability limit for the respective refrigerant in air at the operating temperature; and wherein the processor is further configured to determine the control setpoint to be a gas property value that falls between the gas property value associated with the threshold percentage of the lower flammability limit of the first refrigerant in air at the operating temperature and a gas property value associated with air at the operating temperature.

10. The controller of claim 9, wherein the control setpoint is determined as a gas property value that falls between the gas property value associated with the threshold percentage of the lower flammability limit of the first refrigerant at the given operating temperature and pressure and a gas property value associated with the threshold percentage of a lower flammability limit of the second refrigerant at the given operating temperature.

11. The controller of claim 10, wherein the control setpoint is determined to be an average between the gas property value associated with the threshold percentage of the lower flammability limit of the first refrigerant at the given operating temperature and pressure and the gas property value associated with a threshold percentage of the lower flammability limit of the second refrigerant at the given operating temperature.

12. A method of operating a heating, ventilation, and air conditioning (HVAC) system configured to regulate a temperature of a space, the method comprising:

transferring heat between a working fluid and airflow in a working fluid conduit using an evaporator that is coupled to the working fluid conduit and a blower that moves the airflow across the evaporator, wherein the working fluid includes at least a first refrigerant;

measuring at least one gas property value and an operating temperature of a fluid surrounding the evaporator using a leak detection sensor; determining a control setpoint for a maximum allowable concentration of working fluid in the fluid surrounding the evaporator, wherein the control setpoint corresponds to a gas property value associated with a threshold percentage of a lower flammability limit of the first refrigerant in air at the operating temperature;

determining that the at least one gas property value of the working fluid measured by the leak detection device exceeds the control setpoint at the operating temperature, and after determining that the at least one gas property value exceeds the control setpoint, initiating the blower to move airflow across the evaporator for a duration;

wherein the working fluid comprises a first refrigerant and a second refrigerant;

wherein the gas property value of the first refrigerant is lower than the gas property value of the second refrigerant at the threshold percentage of the lower flammability limit for the respective refrigerant in air at the operating temperature; and wherein the method further comprises determining the control setpoint to be a gas property value that falls between the gas property value associated with the threshold percentage of the lower flammability limit of the first refrigerant in air at the operating temperature and a gas property value associated with air at the operating temperature.

13. The method of claim 12, wherein the method further comprises determining the control setpoint to be a gas property value that falls between the gas property value associated with the threshold percentage of the lower flammability limit of the first refrigerant at the given operating temperature and pressure and a gas property value associated with the threshold percentage of a lower flammability limit of the second refrigerant at the given operating temperature.

14. The method of claim 13 wherein the method further comprises determining the control setpoint is to be an average between the gas property value associated with the threshold percentage of the lower flammability limit of the first refrigerant at the given operating temperature and pressure and the gas property value associated with a threshold percentage of the lower flammability limit of the second refrigerant at the given operating temperature.

15. The method of claim 14, wherein the average gas property value between the first refrigerant and the second refrigerant is scaled based on a concentration of the first refrigerant and the second refrigerant in the working fluid.

16. The method of claim 12, wherein the first refrigerant is an A2L refrigerant.

17. The method of claim 12, wherein the at least one gas property value is selected form a speed of sound, thermal conductivity, or combinations thereof.

* * * * *